US005098217A

United States Patent [19]

Hedgewick et al.

[11] Patent Number: 5,098,217

[45] Date of Patent: Mar. 24, 1992

[54] ABRASION RESISTANT COATING FOR PAVEMENT MARKER

[75] Inventors: Peter Hedgewick, Windsor, Canada; Douglas S. Forrer, Heath, Ohio

[73] Assignee: Pac-Tec, Inc., Heath, Ohio

[21] Appl. No.: 527,754

[22] Filed: May 23, 1990

[51] Int. Cl.[5] ..... G08B 5/02

[52] U.S. Cl. ..... 404/14

[58] Field of Search ..... 404/12-16; 350/102, 103, 109

[56] References Cited

U.S. PATENT DOCUMENTS

| | | | |
|---|---|---|---|
| 3,332,327 | 10/1964 | Heenan | 404/16 |
| 3,409,344 | 11/1968 | Balint | 350/103 |
| 3,693,511 | 9/1972 | Medynski | 404/16 X |
| 3,971,623 | 7/1976 | Hedgewick et al. | 404/16 X |
| 3,975,108 | 8/1976 | Suhr et al. | 404/16 |
| 4,008,973 | 2/1977 | Montigny | 404/16 |
| 4,227,772 | 10/1980 | Heenan | 350/103 |
| 4,232,979 | 11/1980 | Johnson et al. | 350/103 X |
| 4,340,319 | 7/1982 | Johnson, Jr. | 404/16 |
| 4,753,548 | 6/1988 | Forrer | 404/15 |
| 4,797,024 | 1/1989 | Forrer | 404/16 |
| 4,815,890 | 3/1989 | Duncan | 404/15 |
| 4,875,798 | 10/1989 | May | 404/12 |

*Primary Examiner*—Ramon S. Britts
*Assistant Examiner*—Roger J. Schoeppel
*Attorney, Agent, or Firm*—Gifford, Groh, Sprinkle, Patmore and Anderson

[57] ABSTRACT

A pavement marker for a roadway surface includes a lower base portion and a retro-reflective lens mounted on the base portion at an angle to it. A photopolymerizable clear acrylic protective hard coat is deposited over and integrally formed with the front face of the lens for resisting abrasion of the lens and reducing the loss of optical efficiency resulting from such abrasion. The pavement marker also includes a frame of generally arcuate cross-section formed about an edge of the hard coat potentially susceptible to peeling from impact of vehicle tires against the hard coat. The frame is preferably formed as a bead raised from the face of the marker, and the bead includes a sharp interior edge lying generally perpendicular to the lens, adjacent the edge of the hard coat.

14 Claims, 2 Drawing Sheets

ABRASION RESISTANT COATING FOR PAVEMENT MARKER

BACKGROUND OF THE INVENTION

I. Field of the Invention

The present invention relates to roadway reflectors, and more particularly, to roadway reflectors of the type adapted to be mounted on a roadway to reflect light from the headlight of an oncoming automotive vehicle and thereby delineate the traffic lanes of the road to the driver of the vehicle.

II. Description of the Prior Art

Reflective roadway markers are used by highway departments and by others for delineating highway lines (such as traffic lanes) on pavement. Properly designed reflective markers are clearly visible at night by reflecting light from an oncoming vehicle back to the vehicle. Such markers generally include a body and some sort of a reflective lens supported by the body.

U.S. Pat. No. 3,409,344 (Balint et al, Nov. 5, 1968) discloses a roadway marker including a housing molded in situ about a plurality of reflective inserts, the inserts having substantially flat outer surfaces and a plurality of retro-reflective prisms on their inner surfaces. The inner surfaces of the prisms are coated with a metalized layer, and the entire housing is filled with a plastic material in order to provide strength and rigidity to the marker.

U.S. Pat. No. 3,332,327 (Heenan, July 25, 1967) discloses a similar pavement marker adapted to be placed on highways. The pavement marker has a front face inclined at a predetermined angle with respect to the roadway surface, so that a self-cleaning effect is provided by virtue of the predetermined angle. The angle that the reflective lens makes in relation to the pavement surface affects the relative efficiency of the retro-reflective prism surfaces; it is generally desired to select the angle so that the reflective efficiency of the prism surface is maximized.

U.S. Pat. No. 4,340,319 (Johnson et al) and U.S. Pat. No. 3,332,327 each disclose that mechanical abrasion of the front face of the lens portion of a pavement marker decreases when the angle of the front face increases. As that angle increases, however, the cleaning action obtained by tire wiping on the front face of the lens decreases. For reflective lenses including orthogonal (cubic corner) retroreflective prisms, satisfactory optical effectiveness is obtained when the angle of the front face of the lens member is disposed between 15 and 45 degrees to the horizontal, and most preferably at about 30 degrees to the horizontal.

U.S. Pat. No. 4,340,319 also notes that the problem of abrasion becomes particularly acute when pavement markers are used in areas where abrasive materials such as salt are distributed over the roadway surface during winter months. Typically, such pavement markers will include soft plastic lenses having fine optical quality. Unfortunately, such lenses are highly susceptible to abrasion. It has been found in use that sand and salt are continually brought into contact with the lenses from the wiping action of the vehicle tires. The combination of such abrasive materials and the wiping action of them tends to scratch and grind the front face of the lens and diminish the optical effectiveness and reflective quality of the pavement marker.

U.S. Pat. No. 4,340,319 attempts to solve this problem by providing a layer of untempered glass sheet disposed under tension on the light receiving and refracting portion of the lens. Glass was utilized because other possible coatings for the lens either were known to be unable to provide adequate abrasion resistance, or required curing temperatures which were so high that the temperatures distorted the plastic material of the reflector, thereby deteriorating the reflector optics seriously. In at least one figure, the glass face is shown most deeply recessed at its lowermost edge. The brow which retains the glass face in position under tension appears to be formed smoothly and continuously with the top and lateral faces of the marker, and appears not to extend or protrude above those faces.

A marker believed to incorporate the invention claimed in U.S. Pat. No. 4,340,319 is sold by Stimsonite Products, Amerace Corporation, Niles, Illinois, under the name "Stimsonite 948 Reflective Pavement Marker." The marker is described as including a glass face recessed within the shell of the marker. The glass face is untempered and is held in place under tension by and beneath an extended brow. The asserted purpose for recessing the glass face is to reduce top edge deterioration. The marker is sold for use in climates where snowplowing does not occur.

The pavement marker disclosed in U.S. Pat. No. 4,753,548 (Forrer, June 28, 1988) solved these and other problems by providing a photopolymerizable acrylic resin composition as a hard coat on the front surface of the retro-reflective lens in such pavement markers. When polymerized, the clear acrylic hard coat provided a resistance to abrasion superior to the abrasion resistance of the soft plastic lens, while it simultaneously avoided both the expense and potential for separation of a multipiece construction such as that shown in U.S. Pat. No. 4,340,319 and any distortion of the plastic material of the reflector encountered with thermocuring resins. Indeed, the top coat of acrylic in U.S. Pat. No. 4,753,548 was preferably formed integrally with and in situ upon the front surface of the lens.

This prior art construction is more particularly shown in FIGS. 1 and 2. A pavement marker constructed in accordance with U.S. Pat. No. 4,753,548 is generally shown at 10. The pavement marker 10 includes a housing 12 having a lower base portion 14 which is adapted to be adhered to a roadway surface 16. The housing 12 is hollow and includes one or more side walls 18 extending substantially upwardly from the base portion 14.

A retro-reflective lens 20 is mounted on at least one of the walls 18. The lens 20 has a front surface 22 facing outwardly from the wall 18. An abrasion resistant photopolymerizable acrylic protective hard coat 24 is deposited over the lens 20 for resisting abrasion of the lens 20 and reducing the loss of optical efficiency resulting from abrasion. The protective hard coat 24 is chemically adhered to and formed integral with the front surface 22 of the lens 20. The lens 20 also includes a rear face 26 having a plurality of reflex-reflector prisms 28 on at least a portion of the rear face 26. The lens 20 is received in a recess 30 in the wall 18. The hollow interior of the housing 12 is filled with a suitable filler 32, such as sand bound with an aggregating agent, adhereable to both the interior surface of the housing 12 and the rear surface 26 of the lens 20.

Again, the specific method of constructing such a pavement marker and the functions of each of its particular elements are discussed in more detail in U.S. Pat.

No. 4,753,548 and U.S. Pat. No. 3,409,344, the disclosures of which are incorporated by reference herein.

In use, as shown in FIG. 2, the pavement marker 10 is adhered to the roadway surface 16 on which a vehicle including a vehicle tire 34 rides. When the marker 10 is impacted by the tire 34, such as when the driver of the vehicle changes traffic lanes, the tire 34 moves from its first position shown in solid line in FIG. 2 to its position shown in phantom in FIG. 2, abutting the marker wall 18 and abraiding the hard acrylic coating 24 on the lens 22. The force of impact is particularly acute at the upper edge 36 of the wall 18. Repeated impacts from vehicle tires, particularly under conditions where there is salt or sand on the road, result in the greatest likelihood of wear and/or peeling of the coating 24 at its top edge 38. Such abrasive wear or peeling would obviate the advantages intended to be achieved by the use of the abrasion resistant hard coat 24.

SUMMARY OF THE PRESENT INVENTION

The present invention overcomes this potential for excessive abrasion or peeling by providing a frame adjacent to at least the upper edge of the hard coat in this type of marker, so as to prevent the impact of a vehicle tire against the upper edge of the hard coat and thereby obviate the potential for any peeling of it from the upper surface of the retro-reflective lens. More particularly, the present invention provides a pavement marker adapted for withstanding the impact of a vehicle tire, which is subject to a reduced likelihood of separation or peeling of its top coat due to such impact.

The pavement marker according to the present invention comprises a lower base portion and a retro-reflective lens mounted to the base portion at a suitable angle to reflect light from the headlight of an oncoming vehicle back to the driver of the vehicle, thereby delineating traffic lanes. The marker of the present invention also comprises an abrasion resistant means deposited over the lens for resisting abrasion of the lens and reducing the loss of optical efficiency resulting from such abrasion. The marker of the present invention further includes means, such as a frame positioned adjacent at least one edge of the abrasion resistant means, for obviating peeling at the edge by preventing the impact of a vehicle tire against the edge of the abrasion resistant means. The abrasion resistant means preferably comprises a hard coat of photopolymerizable acrylic resin of U.S. Pat. No. 4,753,548.

The frame preferably comprises a bead of generally circularly arcuate configuration protruding or extending outwardly of the top and lateral faces of the marker. The bead can include a sharp bead edge disposed generally perpendicular to the lens adjacent at least that edge of the hard coat most subject to impact.

The present invention is thus particularly advantageous over the earlier pavement markers in that the relatively simple yet efficient and effective construction of the prior markers is retained, while a superior reliability and a longer resistance to abrasive wear are achieved.

BRIEF DESCRIPTION OF THE DRAWING

A better understanding of the present invention will now be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 3:
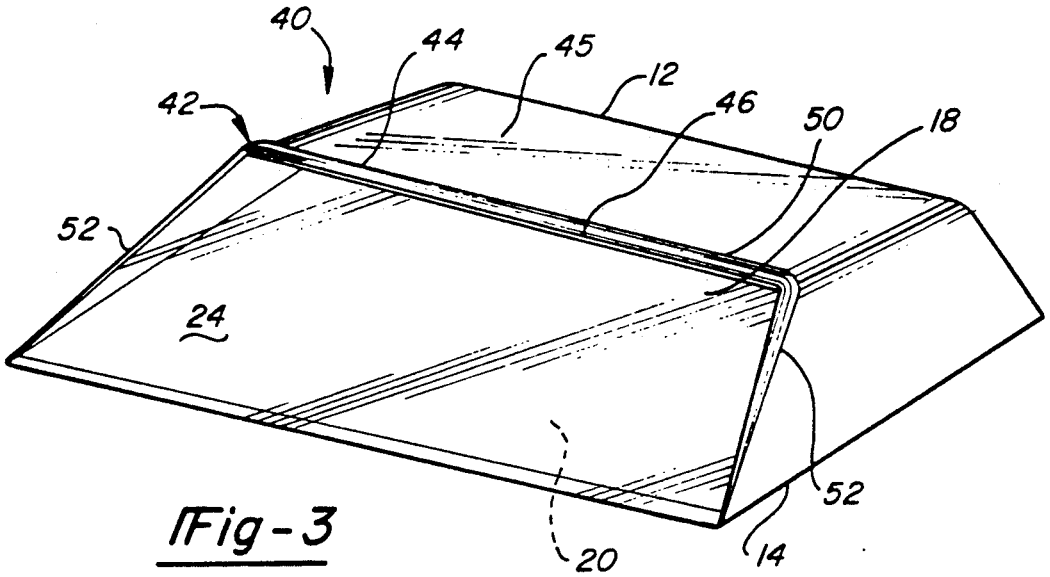
FIG. 3 is a perspective view of the preferred embodiment of the present invention.
Figure 4:
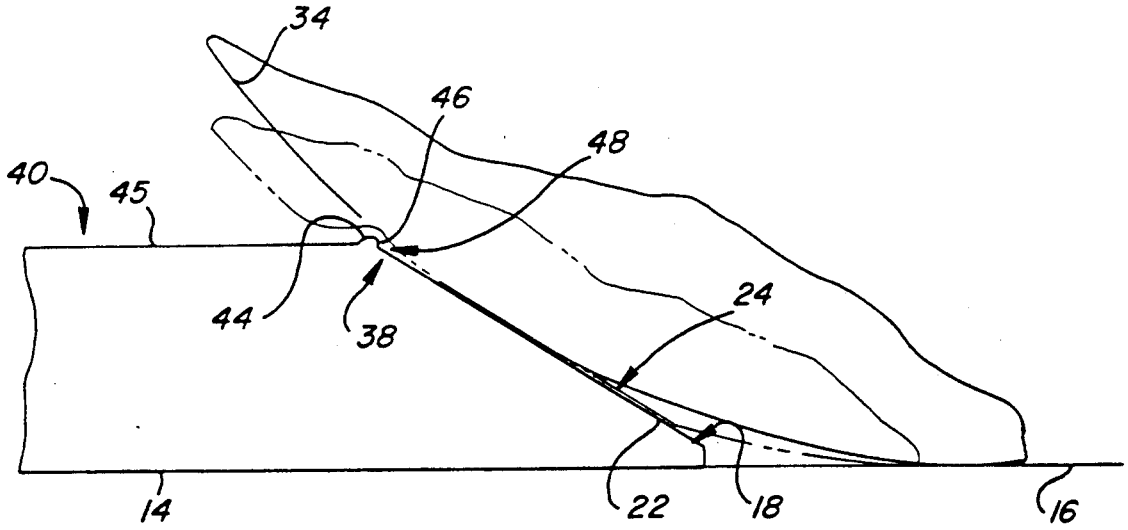
FIG. 4 is a side view of the preferred embodiment of the present invention in its normal environment of use.

With reference to FIGS. 3 and 4, a pavement marker 40 constructed in accordance with the present invention is thereshown. The marker 40 is preferably constructed in major part in the same fashion as the marker generally shown at 10 in U.S. Pat. No. 4,753,548, and the disclosure of that patent is expressly incorporated by reference herein. The marker 40 of the present invention thus includes a housing 12 having a lower base portion 14 adapted to be adhered to a roadway surface 16. The marker 40 includes a retro-reflective lens 20 carried by the housing 12. Unlike the marker 10, the lens 20 is preferably formed as a single piece with the housing 12 during molding of the housing 12. Like the marker 10, however, the marker 40 includes a photopolymerized acrylic protective hard coat 24 over the front surface 22 of the lens 20. The hard coat 24 and front lens surface 22 together define a front face 18 of the marker.

The pavement marker 40 of the present invention additionally comprises an impact and peeling obviating means, such as a frame 42, positioned adjacent to at least the upper edge 38 of the hard coat 24, and preferably extending about three sides of the hard coat 24. The frame 42 is conveniently formed as a raised bead 44 of generally circularly arcuate cross section; that is, the bead 44 lies at least in part (and preferably fully) above the plane defined by the top marker surface 45, and outward and forward of the marker front face 18. The bead 44 preferably has a radius curvature of about 0.03 inches. The bead 44 includes an interior bead edge 46 immediately adjacent at least the upper edge 38 of the hard coat 24. The interior bead edge 46 is relatively sharp and lies generally perpendicular to the front surface 22 of the lens 20.

The purpose of the frame 42 is to absorb or deflect the impacting shock which would otherwise be imposed upon the edges of the hard coating 24, particularly the upper edge 38 of the hard coat 24. The frame 42 achieves this goal by deforming the tire 34 as it passes over the pavement marker 40. When the tire 34 passes over the marker 40, the frame 42 forms a small depression 48 in the surface of the tire 34. Conventional vehicle tires 34, of course, will not possess sufficient plasticity to deform enough to make contact with the edge 38 of the hard coat 24 which lies adjacent to the frame 42. Thus, abrasive impact which would otherwise result in abrasive pressure being applied to the hard coat 24, particularly the edge 38 of the hard coat 24, and which could possibly cause peeling of the coat 24 from the surface 22 of the lens 20, is avoided.

The frame 42 preferably includes an upper portion 50 running along the upper edge of the face 18, and a pair of downwardly tapering portions 52 on the lateral edges of the face 18. The lateral portions 52 are tapered because the lower portion of the hard coat 24 will, in use, receive less impact from the tire 34, and accordingly needs less protection by the frame 42. It is preferred, however, that the depending portions 52 lie immediately adjacent the lateral edges of the hard coat 24.

Figure 1:
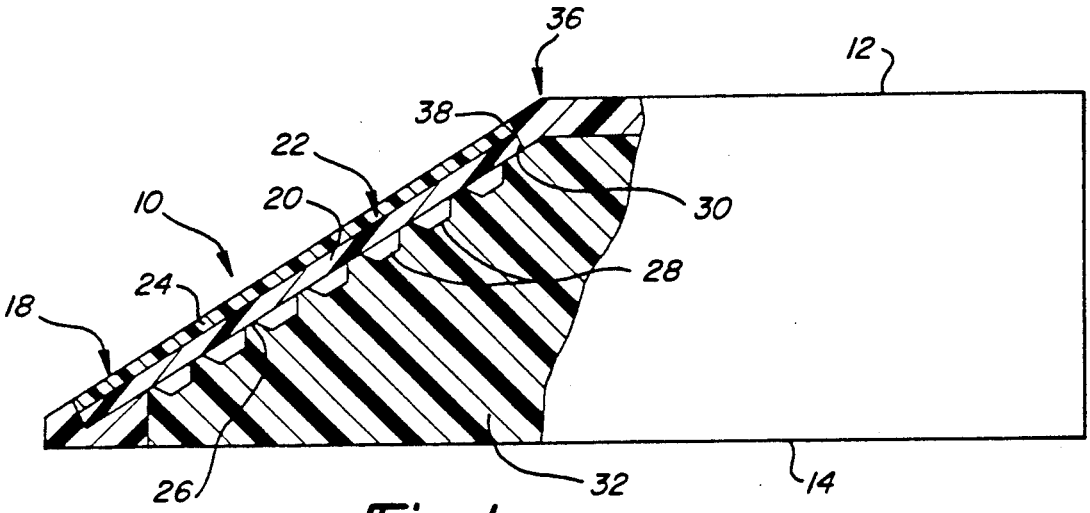
Fig-1 PRIOR ART
FIG. 1 is a cross-sectional view of a pavement marker of the prior art.
Figure 2:
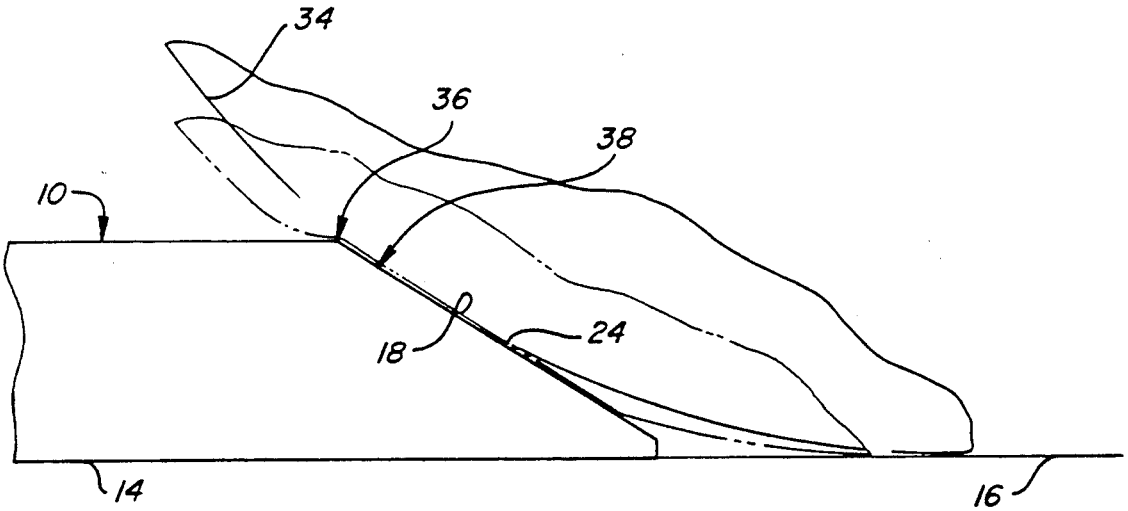
Fig-2 PRIOR ART
FIG. 2 is a side view showing the use of the pavement marker of FIG. 1.

While the preferred marker 40 of the present invention has been described as incorporating a retroreflective lens 20 unitarily formed with the marker housing 12, the peeling obviating means exemplified by the frame 42 can be employed with pavement markers of other types, such as the marker 10 of FIG. 1 in U.S. Pat. No. 4,753,548, in which the lens 20 is bonded as an insert in a recess 30 in the wall 18. The peeling obviating means will, of course, be useful with other types of pavement markers as well. Moreover, while the frame 42 has been disclosed as a continuous bead, alternative structures such as an intermittent bead or a line of raised portions can be equivalents of the frame bead 44, serving in the same fashion to distort the surface of a tire passing over the marker and create a similar gap between the tire surface and the edge of the hard coat 24, and thereby achieve the advantages enjoyed by the present invention.

The invention having been described, however, many modifications thereto will become apparent to those skilled in the art to which it pertains, without deviation from the spirit of the present invention, as defined by the scope of the appended claims.

What is claimed is:

1. A pavement marker adapted to reflect light from the headlight of a vehicle and to withstand impact of a tire of said vehicle thereagainst, comprising:

a base portion;

a retro-reflective lens mounted to said base portion; said leans having an essentially transparent abrasion resistant coating disposed over said lens for resisting abrasion of said lens and reducing the loss of optical efficiently resulting from such abrasion, said leans and said coating together defining a generally continuous, smooth front surface of said marker, said coating including an upper edge extending in a generally horizontal direction, said upper edge potentially susceptible to peeling from impact of a vehicle tire thereagainst; and a bead formed on said base, said bead extending adjacent said upper edge of said abrasion resistant means, said bead extending a predetermined distance outwardly from said generally smooth front surface for presenting impact of a vehicle tire against said upper edge and permitting substantial contact of said tire against said coating to clean said front surface.

2. The marker according to claim 1, wherein said bead is of generally arcuate cross section, having a radius of about 0.03 inches.

3. The marker according to claim 1, wherein said bead includes a sharp bead edge generally perpendicular to said lens, adjacent said edge of said abrasion resistant means.

4. The marker according to claim 1, wherein said lens is disposed at an angle with respect to said base, said angle being adequate to reflect light from said vehicle back towards said vehicle.

5. The marker according to claim 1, wherein said lens comprises a rear face having a plurality of reflexreflector prisms on at least a portion of said rear face.

6. The marker according to claim 1, wherein said lens comprises a front face, and said abrasion resistant means is disposed directly on said front face of said lens.

7. The marker according to claim 1, wherein said abrasion resistant means is adhered to and is integral with said lens.

8. The marker according to claim 1, wherein said abrasion resistant means comprises an acrylic resin.

9. The marker according to claim 1, wherein said abrasion resistant means comprises a photopolymerized resin.

10. The marker according to claim 1, wherein said abrasion resistant means comprises a mixture of di-pentaerithritol hydroxypenta-acrylate and 1,6-hexanediol diacrylate.

11. The marker according to claim 1, wherein said abrasion resistant means includes at least one of an ultraviolet stabilizer, a photopolymerization initiator, and a surface smoothness enhancer.

12. The marker according to claim 1, wherein said abrasion resistant means includes, in parts by weight:

| | |
|---|---|
| di-pentaerithritol hydroxypenta-acrylate | 32.0 |
| 1,6-hexanediol diacrylate | 8.0 |
| hindered amine stabilizer | 0.2 |
| substituted benzotriazole stabilizer | 0.2 |
| non-hydrolyzable silicone glycol copolymer | 0.2 |
| fluorochemical durfactant | 0.2 |
| benzophenone | 1.0 |
| 1-hydroxycyclohexyl phenyl ketone | 1.0 |
| methyl ethyl ketone | 37.2 |
| isobutyl isobutyrate | 20.0 |

13. The marker according to claim 1, wherein said bead extends in a generally horizontal direction.

14. The marker according to claim 1, wherein said front surface has a pair of side edges extending from said top edge, said bead extending adjacent said top surface and said pair of side surfaces to form a frame.

* * * * *

UNITED STATES PATENT AND TRADEMARK OFFICE
Certificate

Patent No. 5,098,217 Patented: March 24, 1992

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Peter Hedgewick, Windsor, Canada; Douglas S. Forrer, Heath, OH; and James E. Fleischer, Evansville, IN.

Signed and Sealed this Twenty-Second Day of July 2003.

DAVID J. BAGNELL
*Supervisory Patent Examiner*
Art Unit 3672